US010213828B2

(12) United States Patent
Watanabe et al.

(10) Patent No.: US 10,213,828 B2
(45) Date of Patent: Feb. 26, 2019

(54) METHOD FOR PRODUCING CASTINGS, CASTING APPARATUS, AND GAS-BLOWING NOZZLE USED IN CASTING APPARATUS

(71) Applicant: HITACHI METALS, LTD., Minato-ku, Tokyo (JP)

(72) Inventors: Hiroyuki Watanabe, Moka (JP); Toru Iwanaga, Moka (JP); Lin Wang, Moka (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/846,588

(22) Filed: Dec. 19, 2017

(65) Prior Publication Data

US 2018/0111188 A1 Apr. 26, 2018

Related U.S. Application Data

(62) Division of application No. 14/899,651, filed as application No. PCT/JP2014/066248 on Jun. 19, 2014.

(30) Foreign Application Priority Data

Jun. 20, 2013 (JP) ..... 2013-129326

(51) Int. Cl.
*B22D 18/04* (2006.01)
*B22D 27/13* (2006.01)

(52) U.S. Cl.
CPC ..... *B22D 18/04* (2013.01); *B22D 27/13* (2013.01)

(58) Field of Classification Search
CPC ..... B22C 9/082; B22D 18/04; B22D 27/09; B22D 27/13
(Continued)

(56) References Cited

U.S. PATENT DOCUMENTS 2,155,800 A * 4/1939 Perazo ..... B22C 9/082 164/162
5,297,610 A 3/1994 Noguchi et al.
(Continued)

FOREIGN PATENT DOCUMENTS

CN 1947893 A 4/2007
CN 101262968 A 9/2008
(Continued)

OTHER PUBLICATIONS

EPO machine translation of JP 10249512 A (Year: 1998).*
(Continued)

*Primary Examiner* — Kevin E Yoon
(74) *Attorney, Agent, or Firm* — Sughrue Mion, PLLC

(57) ABSTRACT

A method for producing a casting by pouring a metal melt by gravity into a gas-permeable casting mold having a cavity comprising at least a sprue, a runner and a product-forming cavity, comprises pouring a metal melt into a desired cavity portion including the product-forming cavity through the sprue, the melt being in a volume smaller than the volume of an entire cavity of the gas-permeable casting mold and substantially equal to the volume of the desired cavity portion; supplying a gas to the desired cavity portion through the sprue before the desired cavity portion is filled with the poured melt, so that the melt fills the desired cavity portion and solidifies; the gas being supplied from a gas-blowing nozzle fit into the sprue.

5 Claims, 4 Drawing Sheets

(58) Field of Classification Search
USPC ..... 164/119, 120
See application file for complete search history.

(56) References Cited

U.S. PATENT DOCUMENTS

| | | | |
|---|---|---|---|
| 6,035,923 | A | 3/2000 | Oda et al. |
| 2009/0151887 | A1 | 6/2009 | Goka |

FOREIGN PATENT DOCUMENTS

| | | | |
|---|---|---|---|
| CN | 101391294 | A | 3/2009 |
| JP | 55122962 | U | 9/1980 |
| JP | 07100606 | A | 4/1995 |
| JP | 10-249512 | A | 9/1998 |
| JP | 2007-75862 | A | 3/2007 |
| JP | 2010-269345 | A | 12/2010 |
| JP | 2012115896 | A | 6/2012 |

OTHER PUBLICATIONS

Communication dated Sep. 19, 2017 from the Japanese Patent Office in counterpart Japanese application No. 2015-522969.
Communication dated Sep. 20, 2016 from the State Intellectual Property Office of the P.R.C. in counterpart Application No. 201480034927.5.
"Cone fitting method B 0616", JIS handbook Machine element, Japanese Standards Association, Apr. 20, 1996, pp. 547-553 (pp. 2-8E, 7 pages).
International Search Report for PCT/JP2014/066248 dated Jul. 15, 2014.
EPO machine translation of JP 2010-269345, dated Dec. 2, 2010.
http://www.moldex.com/healthcare/non-product/fit-instructions/hearing/reusable-earplug-comets.php, 2007.

* cited by examiner

METHOD FOR PRODUCING CASTINGS, CASTING APPARATUS, AND GAS-BLOWING NOZZLE USED IN CASTING APPARATUS

CROSS REFERENCE TO RELATED APPLICATIONS

This application is a divisional of application Ser. No. 14/899,651 filed Dec. 18, 2015, which is a National Stage of International Application No. PCT/JP2014/066248 filed Jun. 19, 2014 (claiming priority based on Japanese Patent Application No. 2013-129326 filed Jun. 20, 2013), the contents of which are incorporated herein by reference in their entirety.

FIELD OF THE INVENTION

The present invention relates to a method for producing desired castings by a gas-permeable casting mold, an casting apparatus, and a gas-blowing nozzle used in the casting apparatus.

BACKGROUND OF THE INVENTION

To produce castings by gravity pouring, a casting mold composed of sand particles, which is a gas-permeable casting mold (a so-called sand mold), is most generally used. With such a gas-permeable casting mold, which may be simply called "mold," a gas (generally air) remaining in a cavity of a particular shape is pushed out of the cavity by a metal melt (simply called "melt"), and the melt is formed into a casting having substantially the same shape as the cavity. The cavity of the casting mold generally includes a sprue, a runner, a feeder and a product-forming cavity, into which a melt is supplied in this order. When a melt head in the sprue becomes high enough to fill a product-forming cavity, the pouring of the melt is finished.

A solidified melt forms a casting integrally extending from the sprue to the runner, the feeder and the product-forming cavity. The feeder is not an unnecessary portion for obtaining sound castings, while the sprue and the runner are merely paths for a melt to reach the product-forming cavity, which need not be filled with the melt. Thus, as long as a melt is solidified in a state of filling the sprue and the runner, drastic improvement in a pouring yield cannot be expected. In the case of castings integrally having unnecessary portions, considerable numbers of steps are needed to separate cast products from unnecessary portions, resulting in low production efficiency. Accordingly, the sprue and the runner pose large problems in increasing efficiency in gravity casting.

A revolutionary method for solving the above problems is proposed by JP 2007-75862 A and JP 2010-269345 A. To fill a desired cavity portion, part of a cavity in a gas-permeable casting mold, this method pours a metal melt in a volume smaller than that of an entire cavity in a gas-permeable casting mold (hereinafter referred to as "casting mold cavity") and substantially equal to that of the desired cavity portion, into the cavity by gravity; supplies a gas (compressed gas) into the cavity through a sprue before the melt fills the desired cavity portion; and then solidifies the melt filling the desired cavity portion. By this method commonly disclosed in JP 2007-75862 A and JP 2010-269345 A, which may be called "pressure-casting method," it is expected to make it substantially unnecessary to fill a sprue and a runner with a melt, because pressure to be obtained by the melt head height is given by the compressed gas.

As a result of experiment to follow the pressure-casting method described in JP 2007-75862 A and JP 2010-269345 A, the inventors have found that in the method of JP 2007-75862 A for closing a sprue with a flange of a gas-supplying pipe to prevent the leak of a compressed gas supplied through the sprue, the positioning of the gas-supplying pipe in the sprue is difficult because the flange conceals the sprue, likely resulting in a slow gas-supplying timing and cold shut in products. In addition, because melt droplets scattered while pouring are likely attached to the sprue in contact with the flange, providing a gap between the flange and the sprue, a large amount of a gas may leak. It is thus desired to develop a means capable of supplying a gas quickly and surely after pouring a melt.

OBJECT OF THE INVENTION

Accordingly, an object of the present invention is to provide a production method of castings, which can supply a gas quickly after pouring a melt without suffering gas leak, a casting apparatus, and a gas-blowing nozzle used in the casting apparatus.

DISCLOSURE OF THE INVENTION

As a result of intensive research in view of the above object, the inventor has found that with a gas-blowing nozzle having a structure of fitting it into a sprue, a gas can be supplied quickly and surely after pouring a melt. The present invention has been completed based on such finding.

Thus, the method of the present invention method for producing a casting by pouring a metal melt by gravity into a gas-permeable casting mold having a cavity comprising at least a sprue, a runner and a product-forming cavity, comprises the steps of

- pouring a metal melt into a desired cavity portion including the product-forming cavity through the sprue, the melt being in a volume smaller than the volume of an entire cavity of the gas-permeable casting mold and substantially equal to the volume of the desired cavity portion; and
- supplying a gas to the desired cavity portion through the sprue before the desired cavity portion is filled with the poured melt, so that the melt fills the desired cavity portion and then solidifies;
- the gas being supplied from a gas-blowing nozzle fit into the sprue.

It is preferable that the gas-blowing nozzle has a side surface tapered in a gas-ejecting direction; that the sprue has a wall surface tapered in a melt flow direction; and that the tapered side surface of the gas-blowing nozzle is fit into the tapered wall surface of the sprue.

When the gas is ejected, the gas-blowing nozzle is preferably pushed in the gas-ejecting direction.

The casting apparatus of the present invention comprises

- a gas-permeable casting mold having a cavity comprising at least a sprue into which a metal melt is poured, a runner constituting a flow path of the melt poured through the sprue, and a product-forming cavity to be filled with the melt supplied through the runner;
- a gas-blowing nozzle for supplying a gas into a cavity of the gas-permeable casting mold through the sprue, such that a metal melt poured into the gas-permeable casting mold by gravity fills only a desired cavity portion including the product-forming cavity; and
- a means for supplying the gas to the gas-blowing nozzle;

the gas-blowing nozzle having a portion fit into the sprue for supplying the gas to the cavity through the sprue.

The fitting portion of the gas-blowing nozzle preferably has a side surface tapered in a gas-ejecting direction.

The gas-blowing nozzle preferably has a gas-ejecting bore having a diameter increasing in a gas-ejecting direction.

It is preferable that the sprue has an introducing hole portion constituting a path through which the metal melt flows downward, and a cup portion open on the gas-permeable casting mold, which is connected to the introducing hole portion and has a larger diameter than that of the introducing hole portion; and that the introducing hole portion has a fitting portion, into which the gas-blowing nozzle is fit.

The fitting portion constituting part of the sprue preferably has a wall surface tapered in a downward flowing direction of the metal melt.

The casting apparatus preferably has a mechanism of pushing the gas-blowing nozzle in the gas-ejecting direction.

The gas-blowing nozzle of the present invention has a side surface tapered in a gas-ejecting direction for supplying a gas into a cavity of a gas-permeable casting mold, which comprises at least a sprue, a runner and a product-forming cavity, through the sprue, such that a metal melt poured into the gas-permeable casting mold by gravity fills only a desired cavity portion including the product-forming cavity.

BRIEF DESCRIPTION OF THE DRAWINGS

FIG. 1(*b*) is a schematic view showing a state where a gas-blowing nozzle is fit into a sprue in Embodiment 1 of the present invention.

FIG. 1(*c*) is a schematic view showing a state where a gas is sent from a gas-blowing nozzle in Embodiment 1 of the present invention.

FIG. 1(*d*) is a schematic view showing a state where a desired cavity portion is filled with a melt in Embodiment 1 of the present invention.

DESCRIPTION OF THE PREFERRED EMBODIMENTS

Figure 1A:
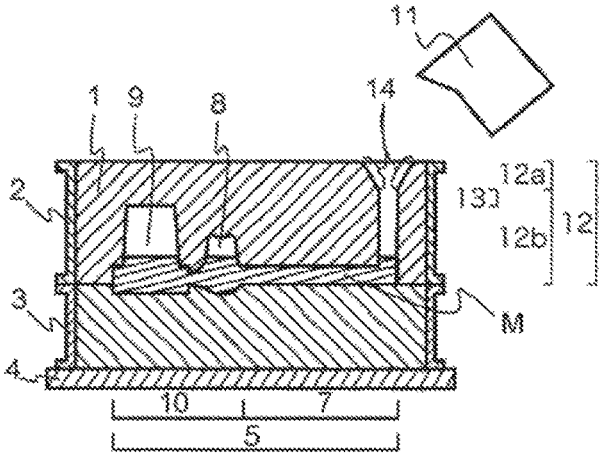
FIG. 1(*a*) is a schematic view showing a state immediately after a melt is poured in Embodiment 1 of the present invention.
Figure 1B:
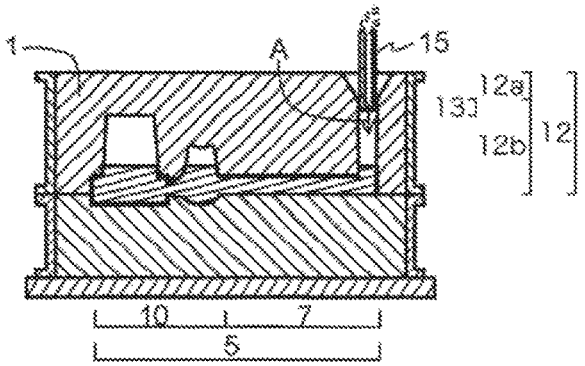
Figure 1C:
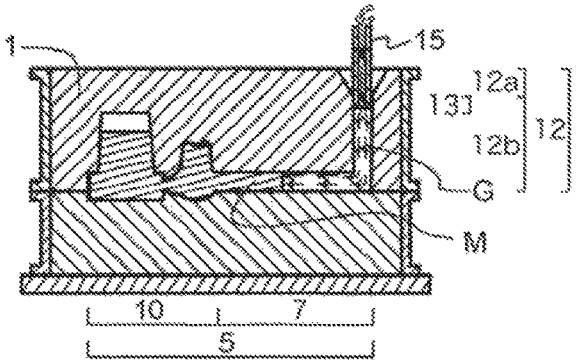
Figure 1D:
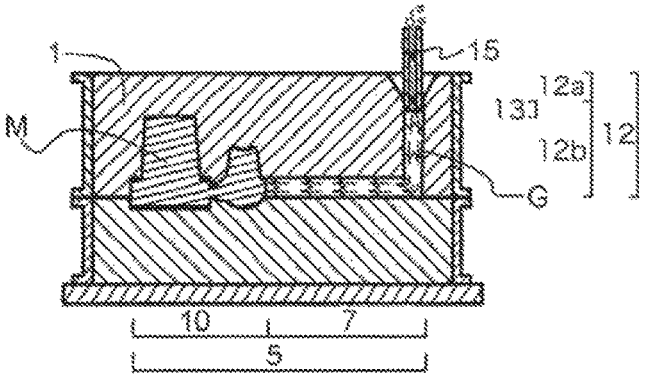

The method of the present invention for producing castings by pouring a metal melt by gravity into a gas-permeable casting mold having a cavity 5 comprising a sprue 12, a runner 7, a feeder 8 and a product-forming cavity 9, as shown in FIG. 1(*a*), comprises the steps of pouring a metal melt M in a volume smaller than the volume of an entire casting mold cavity 5 and substantially equal to the volume of a desired cavity portion 10 comprising the product-forming cavity 9 and the feeder 8, through the sprue 12 into the desired cavity portion 10 to fill it with the metal melt M; supplying a gas to the desired cavity portion 10 through the sprue 12 before the desired cavity portion 10 is filled with the poured melt M, so that the melt M fills the desired cavity portion 10 and solidifies; the gas being supplied from a gas-blowing nozzle 15 fit into the sprue 12. The sprue 12 has a tapered cup portion 12*a* open on the gas-permeable casting mold, and an introducing hole portion 12*b* constituting a path through which the metal melt flows downward. Though the feeder 8 is provided in FIG. 1(*a*), it may be omitted if unnecessary.

After the sprue is exposed to a poured high-temperature melt, an inner wall surface of the sprue appears to be roughened and brittle. As a result of experiments, the inventors have found that the above fitting structure of the sprue, which was never considered before, is effective to solve the problems.

As described above, an important feature of the present invention is that a gas is supplied from a gas-blowing nozzle fit into a sprue constituting a melt flow path. Specifically, the gas-blowing nozzle is inserted into the sprue, and a gas is supplied with a tip end side surface of the gas-blowing nozzle in fixed contact with an inner wall surface of the sprue. The tip end side surface of the gas-blowing nozzle need not be closely attached to the inner wall surface of the sprue, but there may be clearance, as long as the supplied gas can keep enough pressure to charge the melt into the desired cavity portion and solidify it.

The gas-blowing nozzle of the present invention, which constitutes the casting apparatus of the present invention, need not have a member covering a sprue opening, such as a flange, and is easily positioned in the sprue having the fitting structure. Immediately after the completion of fitting, a gas can be supplied, resulting in a fast gas-supplying timing and improved casting tact, while preventing cold shut in products. It also makes it possible to avoid the influence of melt droplets scattered around the sprue.

Materials for the gas-blowing nozzle may be metals such as steel, aluminum alloys, copper alloys, etc., ceramics such as alumina, silicon carbide, etc., composite materials of metals and ceramics, graphite, etc. The gas-blowing nozzle is desirably detachable from the gas-supplying means.

The nozzle may be rotated slidably in the sprue for closer contact with the sprue to achieve higher sealing. Fitting need not be completely gas-tight, but there may be clearance, as long as the supplied gas has enough pressure to charge the melt into the desired cavity portion and solidify it.

The deeper fitting of the nozzle into the sprue provides a larger contact area of the side surface of the nozzle with the sprue, resulting in higher sealing, thereby advantageously preventing gas leak from the sprue. The deeper fitting of the nozzle into the sprue also makes a tip end of the nozzle closer to the product-forming cavity, advantageously decreasing the amount of a gas leaking through the gas-permeable casting mold.

On the other hand, the deep fitting is disadvantageous in taking time in setting the nozzle. Accordingly, a fitting mode is preferably selected depending on the mold and the melt.

It is preferable that the gas-blowing nozzle has a side surface tapered in a gas-ejecting direction, while the sprue has a wall surface tapered in a melt flow direction. It is more preferable that the wall surface of the sprue is substantially equally tapered along the side surface of the gas-blowing nozzle. The above shapes of the gas-blowing nozzle and the sprue make it easy to achieve the contact fitting of the tapered side surface of the gas-blowing nozzle to the tapered wall surface of the sprue. For example, a nozzle having a taper-free, straight side surface cannot be easily positioned at proper depth, in fitting into the sprue with clearance. On the other hand, the tapered side surface of the gas-blowing nozzle can be surely brought into fitting contact with the tapered wall surface of the sprue at a predetermined position. With this structure, the weight of the nozzle per se can be used as part of pressure for contact with the sprue, advantageous for sealing.

In the present invention, the supplied gas filling the sprue and the runner applies pressure to the gas-blowing nozzle to slacken its fitting. Though the weight of the nozzle per se and a friction force between the nozzle and the wall surface of the sprue may be enough to resist this pressure, the gas-blowing nozzle is preferably pushed in a gas-supplying direction during a gas-supplying period to ensure the fitting. As described above, with the side surface of the gas-blowing nozzle tapered complementarily with the wall surface of the sprue, the pushing of the gas-blowing nozzle in a gas-ejecting direction makes the contact of the gas-blowing nozzle with the sprue closer, resulting in improved sealing.

In the present invention, because the gas-ejecting bore of the gas-blowing nozzle has a smaller diameter than that of the sprue, the supplied gas impinges mostly a center portion of the melt in the introducing hole portion of the sprue. Particularly when the gas is supplied at a high speed, the melt is likely splashed from its top surface in an edge portion, so that the melt may not be pushed efficiently. With the gas-ejecting bore of the gas-blowing nozzle having a diameter increasing in a gas-ejecting direction, the gas preferably flows in the introducing hole portion at a uniform speed, avoiding the splashing of the melt, resulting in high efficiency of pushing the melt by the supplied gas.

The basic technology of the present invention will be explained below. The present invention utilizes the basic technology of producing castings by a gas-pressure-casting method, which is proposed by JP 2007-75862 A and JP 2010-269345 A, though not restricted to the disclosures of these references.

In a gas-permeable casting mold having a cavity comprising at least a sprue, into which a metal melt is poured, a runner constituting a flow path of the melt poured through the sprue, and a product-forming cavity to be filled with the melt supplied through the runner, the present invention is directed to a technology of charging a metal melt into only a desired cavity portion including the product-forming cavity. The cavity of the gas-permeable casting mold may have a feeder, if necessary. In this case, the desired cavity portion includes the product-forming cavity and the feeder.

The gas-permeable casting mold is generally a mold formed by sand particles for uniformly having some gas permeability, such as a green sand mold, a shell mold, a self-curing mold, though the mold may be formed by ceramic or metal particles in place of sand particles. The gas-permeable casting mold could be formed by materials having substantially no gas permeability, such as gypsum, etc., if gas-permeable materials were mixed, or partially gas-permeable materials were used to have sufficient gas permeability. Even a mold made of a material having no gas permeability at all, such as a metal die, can be used as a gas-permeable casting mold, when gas permeability is given by gas-flowing holes such as vents, etc.

In the present invention, the melt in a volume smaller than the volume of an entire casting mold cavity and substantially equal to the volume of the desired cavity portion including the product-forming cavity is poured by gravity. The volume of the poured melt is limited, because pouring the melt in such an amount as to completely fill the casting mold cavity does not contribute to improvement in a pouring yield. In a gravity casting method using a conventional gas-permeable casting mold, a melt generally fills an entire cavity including a product-forming cavity and solidifies to obtain sound products, resulting in a pouring yield of at most about 70%. Drastic improvement of the pouring yield has not been expected. On the contrary, using the basic technology of the present invention, the pouring yield of substantially 100% can be expected in principle.

In a cavity structure of filling a desired cavity portion simply by pouring a melt, a gas need not be supplied to fill the cavity. However, when a melt in a volume substantially equal to the volume of the desired cavity portion including the product-forming cavity (further, the feeder, if necessary) is poured as in the present invention, a gas should be supplied before the desired cavity portion is filled with the poured melt, thereby charging the melt into the desired cavity portion through the sprue and solidifying it.

The gas supplied to cause the melt to fill the desired cavity portion may be air from the aspect of cost, or a non-oxidizing gas such as argon, nitrogen, carbon dioxide, etc. from the aspect of preventing the oxidation of the melt. Though the gas may be supplied with a fan, a blower, etc., it is preferable to use a compressor, etc., because it can uniformly pressurize the melt.

Embodiment 1

Embodiment 1 of the present invention will be explained. FIGS. 1(*a*)-1(*d*) are schematic views showing the steps of the production method of a casting in Embodiment 1. This embodiment uses a casting apparatus comprising a gas-blowing nozzle having a straight (taper-free) side surface, and a gas-permeable casting mold comprising an open sprue having a tapered portion, and a straight introducing hole portion connected to the tapered portion, into which the gas-blowing nozzle can be fit.

A mold 1 is a gas-permeable casting mold using green sand, which is placed on a bottom board 4 with an upper flask 2 and a lower flask 3 combined, as shown in FIGS. 1(*a*) to 1(*d*). A casting mold cavity 5 comprises a sprue 12, a runner 7, a feeder 8, and a product-forming cavity 9, and the product-forming cavity 9 and the feeder 8 constitute a desired cavity portion 10. The sprue 12 has a cup portion 12*a* open on the gas-permeable casting mold 1 and having a wall surface 14 tapered downward, and an introducing hole portion 12*b* extending downward from the cup portion 12*a* and having a straight, tubular fitting portion 13, into which the gas-blowing nozzle 15 can be fit. Though the feeder 8 is contained in this embodiment, the feeder 8 may be omitted, if unnecessary.

FIG. 1(*a*) shows a stage immediately after a melt M in a volume substantially equal to that of the desired cavity portion 10 is poured from a ladle 11 to the sprue 12 of the mold 1.

As shown in FIG. 1(*b*), the gas-blowing nozzle 15 is then fit into the fitting portion 13 of the sprue 12 to supply a gas. Because the gas-blowing nozzle 15 in Embodiment 1 has a straight (taper-free) side surface, the gas-blowing nozzle 15 comes into contact not with the cup portion 12*a* but with the straight, tubular fitting portion 13. This method enables easy positioning of the gas-blowing nozzle 15 in the sprue 12 without suffering melt droplets, etc. deteriorating close contact. Accordingly, a gas G can be surely supplied immediately after completing the fitting. To achieve closer contact with the fitting portion for higher-sealing fitting, the gas-blowing nozzle 15 is preferably rotated slidably on the wall surface of the straight, tubular fitting portion 13 of the sprue 12. It is preferable for further closer contact that the gas-blowing nozzle 15 has a slightly larger outer diameter than the diameter of the straight, tubular fitting portion 13, and that the gas-blowing nozzle 15 fit into the straight, tubular fitting portion 13 is pushed in a gas-supplying direction (shown by the arrow A).

As shown in FIG. 1(*c*), the gas G (shown by pluralities of arrows) is then supplied from the gas-blowing nozzle 15 into the casting mold cavity 5, before the solidification of the melt M starts. By this operation, the melt M is pushed toward and charged into the desired cavity portion 10 by the gas G.

As shown in FIG. 1(*d*), after the desired cavity portion 10 is filled with the melt M, the melt M is solidified to complete casting.

Embodiment 2

A preferred mode of fitting a gas-blowing nozzle into a sprue, in which a tapered side surface of the gas-blowing nozzle comes into contact with a sprue wall surface tapered in a melt flow direction, will be explained referring to the drawings.

Figure 2:
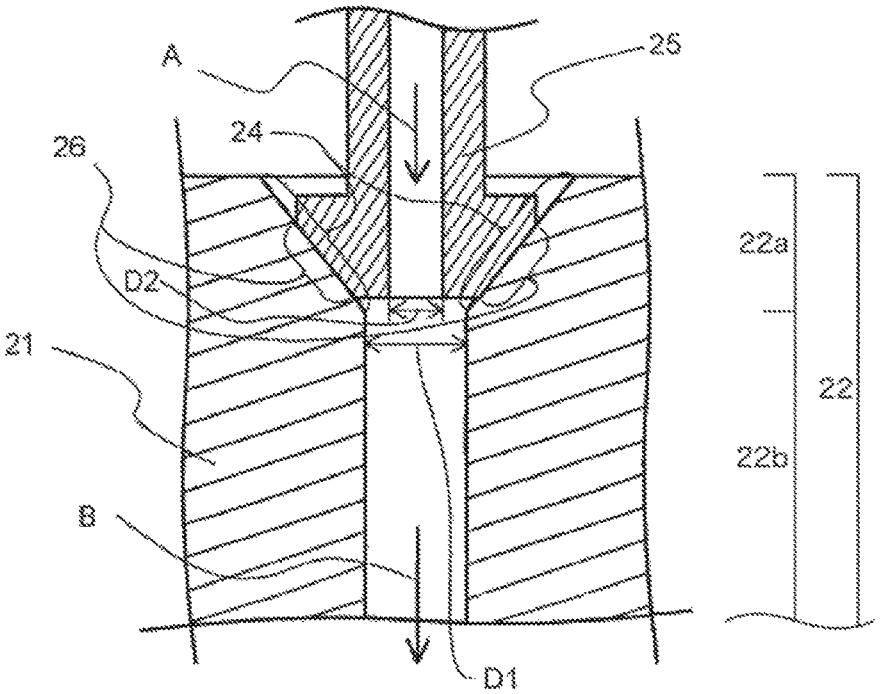
FIG. 2 is a schematic cross-sectional view showing a gas-blowing nozzle and a sprue in Embodiment 2 of the present invention.

FIG. 2 schematically shows the fitting of a gas-blowing nozzle into a sprue in Embodiment 2. A sprue 22 of the gas-permeable casting mold 21 has a cup portion 22*a* open on the gas-permeable casting mold 21 and having a wall surface 24 tapered in a flow direction of a melt poured by gravity (shown by the arrow B), and an introducing hole portion 22*b* extending downward from the cup portion 22*a*. The gas-blowing nozzle 25 having a side surface 26 tapered at substantially the same angle as that of the tapered wall surface 24 of the cup portion 22*a* is brought into contact with the tapered wall surface 24 of the cup portion 22*a* for fitting. The production method of castings in Embodiment 2 is the same as in Embodiment 1, except that the portion of the gas-blowing nozzle fit into the sprue is changed as described above.

Because the gas-blowing nozzle 25 is not deeply inserted into the sprue 22 for fitting in Embodiment 2, its positioning is easier, resulting in a shortened period from the completion of pouring a melt by gravity to the start of supplying a gas. Because melt droplets generated when a melt is poured by gravity are less attached to the tapered wall surface 24, a close contact of the cup portion 22*a* of the gas-blowing nozzle 25 with the tapered wall surface 24 is not deteriorated. To have closer fitting and higher sealing, the gas-blowing nozzle 25 is preferably rotated slidably on the tapered wall surface 24 of the cup portion 22*a*. To achieve further closer contact, the gas-blowing nozzle 25 is preferably pushed in a gas-supplying direction (shown by the arrow A).

Embodiment 3

Figure 3:
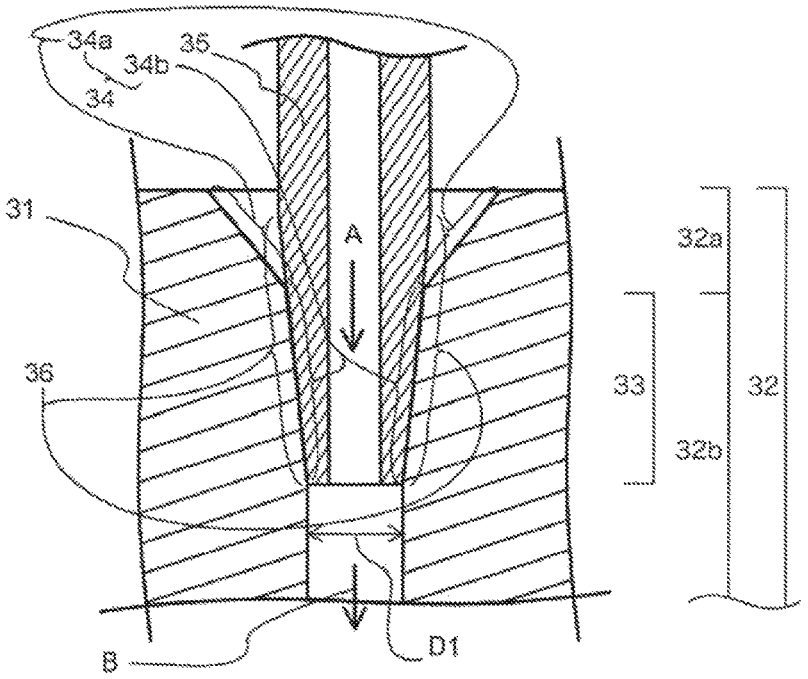
FIG. 3 is a schematic cross-sectional view showing a gas-blowing nozzle and a sprue in Embodiment 3 of the present invention.

FIG. 3 schematically shows the fitting of a gas-blowing nozzle into a sprue in Embodiment 3. A sprue 32 of a gas-permeable casting mold 31 has a cup portion 32*a* open on the gas-permeable casting mold 31 and having a tapered wall surface 34*a*, and an introducing hole portion 32*b* extending downward from the cup portion 32*a* and having a fitting portion 33 having a wall surface 34*b* tapered in a flow direction of a melt poured by gravity (shown by the arrow B). The gas-blowing nozzle 35 can be fit into the sprue 32, with the side surface 36 tapered at substantially the same angle as that of the tapered wall surface 34*b* of the fitting portion 33 brought into contact with the tapered wall surface 34*b* of the fitting portion 33. The production method of castings in Embodiment 3 is the same as in Embodiment 1, except that the portion of the gas-blowing nozzle fit into the sprue is changed as described above.

In Embodiment 3, fitting depth in the sprue 32 can be made constant more easily than when the nozzle having a taper-free side surface in FIG. 1 is used. Also, because melt droplets generated when a melt is poured by gravity are not attached to the tapered wall surface 34, a close contact of the gas-blowing nozzle 35 with the tapered wall surface 34*b* of the fitting portion 33 is not deteriorated by melt droplets. To have closer contact with the fitting portion for higher sealing, the gas-blowing nozzle 35 is preferably rotated, with the tapered side surface 36 sliding on the tapered wall surface 34*b* of the fitting portion 33. The gas-blowing nozzle 35 is preferably pushed in a gas-supplying direction (shown by the arrow A) for closer contact.

Because the tapered wall surface 34*b* of the fitting portion 33 of the sprue 32 in Embodiment 3 has a smaller angle than that of the tapered wall surface 24 in Embodiment 2 in a gas-supplying direction (shown by the arrow A), a center axis of the gas-blowing nozzle 35 is easily aligned with a center axis of the sprue 32, so that positioning is more precise in Embodiment 3 than in Embodiment 2.

Embodiment 4

Figure 4:
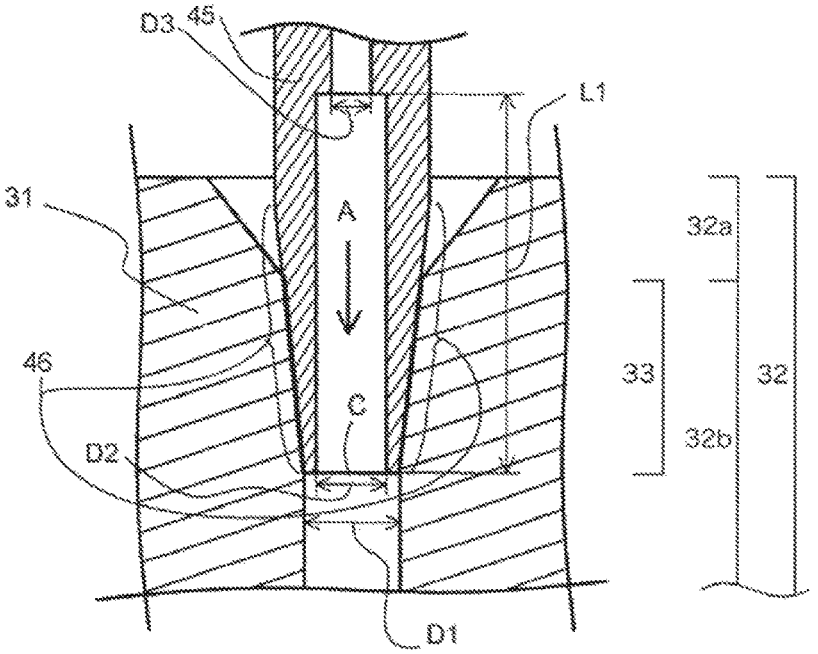
FIG. 4 is a schematic cross-sectional view showing a gas-blowing nozzle and a sprue in Embodiment 4 of the present invention.

This embodiment is the same as Embodiment 3 in a sprue of a gas-permeable casting mold, a side surface of a gas-blowing nozzle, and the fitting of the gas-blowing nozzle into the sprue of the gas-permeable casting mold, except that the gas-blowing nozzle is changed to have a gas-ejecting bore having an increased diameter in a gas-supplying direction as shown in FIG. 4.

As shown in FIG. 4, the gas-ejecting bore of the gas-blowing nozzle 45 has a diameter D2 in an upstream portion of distance L1 from a gas outlet end surface C in a gas-supplying direction (opposite direction to the arrow A), and a diameter D3 in a further upstream portion from a position of the distance L1 from the gas outlet end surface C (D2>D3). Because the bore has a stepwise increasing diameter in a gas-supplying direction (shown by the arrow A), a gas preferably has a uniform flow rate in a bore cross section near the gas outlet. With the sprue 32 having a diameter D1 near the gas outlet, the preferred relations of D1, D2, D3 and L1 are $$0.7\times D1\leq D2\leq 1.0\times D1,$$

$$0.3\times D2\leq D3\leq 0.5\times D2, \text{ and}$$

$$2.5\times D1\leq L1\leq 4.0\times D1.$$

Embodiment 5

Figure 5:
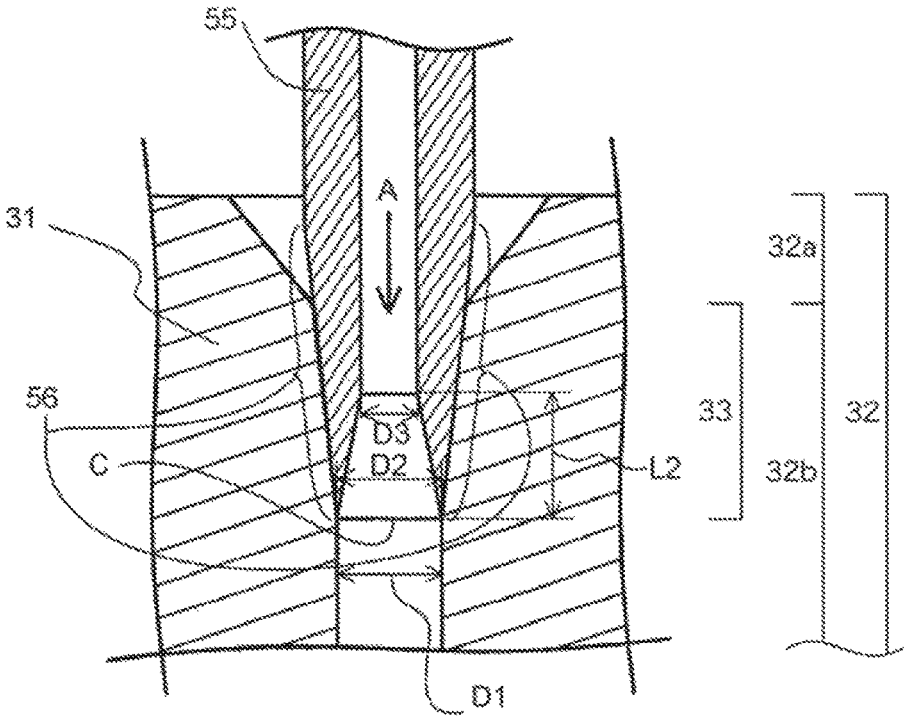
FIG. 5 is a schematic cross-sectional view showing a gas-blowing nozzle and a sprue in Embodiment 5 of the present invention.

This embodiment is the same as Embodiment 3 in a sprue of a gas-permeable casting mold, a side surface of a gas-blowing nozzle, and the fitting of a gas-blowing nozzle into a sprue of a gas-permeable casting mold, except that the gas-blowing nozzle is changed to have a gas-ejecting bore having an increasing diameter in a gas-supplying direction as shown in FIG. 5.

As shown in FIG. 5, the gas-ejecting bore of the gas-blowing nozzle 55 diameter has a diameter continuously increasing from D3 to D2 in a gas-supplying direction in a range from a point upstream (opposite to the arrow A) of a gas outlet end surface C by distance L2 to the gas outlet end surface C. With such a shape, a gas preferably has a uniform flow rate in a bore cross section near the gas outlet. With the sprue 32 having a diameter D1 near the gas outlet C, the preferred relations of D1, D2, D3 and L2 are $$0.9\times D1\leq D2\leq 1.0\times D1,$$

$$0.5\times D2\leq D3\leq 0.8\times D2, \text{ and}$$

$$1.1\times D1\leq L2\leq 1.2\times D1.$$

EFFECTS OF THE INVENTION

The present invention provides a method for producing castings by the pressure-casting method, which can supply a gas quickly after pouring a melt, while preventing leak during gas supply, without using a complicated apparatus. Accordingly, it provides an improved casting tact, with reduced defects such as cold shut.

What is claimed is:

1. A method for producing a casting by pouring a metal melt by gravity into a gas-permeable casting mold having a cavity comprising at least a sprue, a runner and a product-forming cavity, comprising the steps of pouring a metal melt into a desired cavity portion including said product-forming cavity through said sprue, said melt being in a volume smaller than the volume of an entire cavity of said gas-permeable casting mold and substantially equal to the volume of said desired cavity portion; and supplying a gas to said desired cavity portion through said sprue before said desired cavity portion is filled with the poured melt, so that said melt fills said desired cavity portion and solidifies;

said gas being supplied from a gas-blowing nozzle fit into said sprue;

wherein:

the sprue has a cup portion having a tapered wall surface and an introducing hole portion extending downward from the cup portion and having a fitting portion having a tapered wall surface, and the gas-blowing nozzle has a side surface tapered at an angle which is substantially the same as that of the tapered wall surface of the fitting portion, wherein the gas-blowing nozzle is brought into contact with the tapered wall surface of the fitting portion for fitting, and wherein the gas-blowing nozzle has a gas-ejecting bore having an increasing diameter in a gas-supplying direction, wherein the gas-ejecting bore of the gas-blowing nozzle has a diameter continuously increasing from D3 to D2 in a gas-supplying direction in a range from a point upstream of a gas outlet end surface of the gas-blowing nozzle by distance L2 to the gas outlet end surface, and with the sprue having a diameter D1 after the fitting portion in a gas flow direction, $$0.9\times D1\leq D2\leq 1.0\times D1,$$

$$0.5\times D2\leq D3\leq 0.8\times D2, \text{ and}$$

$$1.1\times D1\leq L2\leq 1.2\times D1.$$

2. The method for producing a casting according to claim 1, wherein said gas-blowing nozzle is pushed in a gas-ejecting direction.

3. The method for producing a casting according to claim 1, wherein the gas-blowing nozzle is rotated slidably on the tapered wall surface of the sprue.

4. A casting apparatus comprising a gas-permeable casting mold having a cavity comprising at least a sprue into which a metal melt is poured, a runner constituting a flow path of said melt poured through said sprue, and a product-forming cavity to be filled with the melt supplied through said runner;

a gas-blowing nozzle for supplying a gas into a cavity of said gas-permeable casting mold through said sprue, such that a metal melt poured into said gas-permeable casting mold by gravity fills only a desired cavity portion including said product-forming cavity; and a means for supplying said gas to said gas-blowing nozzle;

said gas-blowing nozzle having a portion fit into said sprue for supplying said gas to said cavity through said sprue;

wherein:

the sprue has a cup portion having a tapered wall surface and an introducing hole portion extending downward from the cup portion and having a fitting portion having a tapered wall surface, and the gas-blowing nozzle has a side surface tapered at an angle which is substantially the same as that of the tapered wall surface of the fitting portion, wherein the gas-blowing nozzle is brought into contact with the tapered wall surface of the fitting portion for fitting, and wherein the gas-blowing nozzle has a gas-ejecting bore having an increasing diameter in a gas-supplying direction, wherein the gas-ejecting bore of the gas-blowing nozzle has a diameter continuously increasing from D3 to D2 in a gas-supplying direction in a range from a point upstream of a gas outlet end surface of the gas-blowing nozzle by distance L2 to the gas outlet end surface, and with the sprue having a diameter D1 after the fitting portion in a gas flow direction, $$0.9\times D1\leq D2\leq 1.0\times D1,$$

$$0.5\times D2\leq D3\leq 0.8\times D2, \text{ and}$$

$$1.1\times D1\leq L2\leq 1.2\times D1.$$

5. The casting apparatus according to claim 4, which has a mechanism of pushing said gas-blowing nozzle in a gas-ejecting direction.

* * * * *